US007726141B2

(12) United States Patent
Sim et al.

(10) Patent No.: US 7,726,141 B2
(45) Date of Patent: Jun. 1, 2010

(54) REFRIGERATOR, AND METHOD FOR CONTROLLING OPERATION OF THE SAME

(75) Inventors: Jae-Seng Sim, Masan-Shi (KR); Young-Hwan Ko, Changwon-Shi (KR); Jongmin Shin, Busan (KR); Bong-Jun Choi, Changwon-shi (KR); Jun-Hyeon Hwang, Changwon-Shi (KR); Young Jeong, Gwangmeong-Shi (KR); Samchul Ha, Changwon-Shi (KR); Yunho Hwang, Ellicott City, MD (US)

(73) Assignee: LG Electronics Inc., Seoul (KR)

( * ) Notice: Subject to any disclaimer, the term of this patent is extended or adjusted under 35 U.S.C. 154(b) by 1488 days.

(21) Appl. No.: 10/871,703

(22) Filed: Jun. 21, 2004

(65) Prior Publication Data

US 2005/0279119 A1 Dec. 22, 2005
US 2008/0229777 A9 Sep. 25, 2008

Related U.S. Application Data

(63) Continuation-in-part of application No. 10/537,828, filed on Jun. 8, 2005, now Pat. No. 7,584,627.

(51) Int. Cl.
*F25D 17/00* (2006.01)

(52) U.S. Cl. ..... 62/179; 62/234; 62/419; 62/441

(58) Field of Classification Search ..... 62/179, 62/180, 441, 443, 81, 151, 276, 155, 234, 62/419, 314, 414, 446, 450
See application file for complete search history.

(56) References Cited

U.S. PATENT DOCUMENTS 3,111,817 A * 11/1963 Solley, Jr. ..... 62/283
3,309,887 A * 3/1967 Jacobus ..... 62/140
3,382,683 A 5/1968 Wiljanen et al.
3,807,493 A * 4/1974 Stewart ..... 165/104.14
4,075,866 A * 2/1978 Williamitis ..... 62/274
4,856,286 A * 8/1989 Sulfstede et al. ..... 62/89
5,377,498 A * 1/1995 Cur et al. ..... 62/187

(Continued)

FOREIGN PATENT DOCUMENTS

EP 0 984 229 3/2000

(Continued)

OTHER PUBLICATIONS

Abstract of JP 09-229532 to Asakawa et al.*

(Continued)

*Primary Examiner*—Mohammad M Ali
(74) *Attorney, Agent, or Firm*—KED & Associates, LLP

(57) ABSTRACT

A refrigerator is provided which can individually cool a freezing chamber and a refrigerating chamber by dividing a heat exchange region of an evaporator into a freezing chamber side region and a refrigerating chamber side region, forming individual circulation passages for supplying cool air from each region to the freezing chamber and the refrigerating chamber, and forming a freezing chamber fan and a refrigerating chamber fan on each circulation passage. Further, a method for controlling operation of the same is provided which can efficiently perform a cooling operation and reduce power consumption by effectively controlling the operations of each component.

15 Claims, 8 Drawing Sheets

U.S. PATENT DOCUMENTS

| | | | | | |
|---|---|---|---|---|---|
| 5,711,161 | A | * | 1/1998 | Gustafson | 62/197 |
| 5,784,895 | A | * | 7/1998 | Choi | 62/407 |
| 5,816,054 | A | * | 10/1998 | Yoo et al. | 62/80 |
| 5,816,060 | A | | 10/1998 | Brownell et al. | 62/186 |
| 6,769,263 | B1 | * | 8/2004 | Armour et al. | 62/187 |
| 2002/0186512 | A1 | * | 12/2002 | Kubotera et al. | 360/266 |
| 2004/0107725 | A1 | | 6/2004 | Lee | 62/441 |
| 2004/0187503 | A1 | * | 9/2004 | Davis et al. | 62/180 |
| 2005/0115272 | A1 | * | 6/2005 | Lim et al. | 62/507 |
| 2006/0005568 | A1 | * | 1/2006 | Sim et al. | 62/419 |

FOREIGN PATENT DOCUMENTS

| | | | | |
|---|---|---|---|---|
| EP | 0 791 162 | | | 3/2004 |
| EP | 1 596 143 | | | 11/2005 |
| JP | 09-229532 | A | * | 9/1997 |
| JP | 11-173729 | A | * | 7/1999 |
| JP | 2001-4260 | A | * | 1/2001 |
| KR | 10-0189103 | B1 | | 1/1999 |
| KR | 10-2001-0026227 | | | 4/2001 |
| KR | 10-2003-0027368 | A | | 4/2003 |
| WO | WO 00/79192 | A1 | | 12/2000 |

OTHER PUBLICATIONS

Search Report.
European Office Action dated Jan. 14, 2008.

* cited by examiner

REFRIGERATOR, AND METHOD FOR CONTROLLING OPERATION OF THE SAME

This application is a Continuation-In-Part of U.S. patent application Ser. No. 10/537,828, filed Jun. 8, 2005, now U.S. Pat. No. 7,584,627 which claims priority to PCT/KR03/02749, filed Dec. 16, 2003, which claims priority to Korean Patent Application 10-2002-0083289 filed Dec. 24, 2002 in Korea.

TECHNICAL FIELD

The present invention relates to a refrigerator which can efficiently perform a cooling operation and reduce power consumption, by individually cooling a freezing chamber and a refrigerating chamber and effectively controlling the operations of each component, and a method for controlling an operation of the same.

BACKGROUND ART

In general, a refrigerator is one of the living necessaries which preserves food fresh for a predetermined period, by lowering a temperature of a freezing chamber or a refrigerating chamber by repeating a refrigeration cycle of compressing, condensing, expanding and evaporating refrigerants.

The refrigerator has a refrigeration cycle including basic components such as a compressor for compressing refrigerants into high temperature high pressure gas refrigerants, a condenser for condensing the refrigerants from the compressor into high temperature high pressure liquid refrigerants, an expansion valve for decompressing the refrigerants from the condenser into low temperature low pressure liquid refrigerants, and an evaporator for maintaining a low temperature in a freezing chamber or a refrigerating chamber, by absorbing heat from the freezing chamber or the refrigerating chamber by evaporating the refrigerants from the expansion valve into low temperature low pressure gas refrigerants.

FIG. 1 is a schematic front perspective view illustrating a conventional side-by-side type refrigerator, and FIG. 2 is a structure view illustrating a refrigeration cycle applied to the refrigerator of FIG. 1.

The conventional side-by-side type refrigerator in which a freezing chamber and a refrigerating chamber are disposed side by side will now be described with reference to FIGS. 1 and 2. A refrigeration cycle including a compressor 12, a condenser 14, an expansion valve 16 and an evaporator 18 is built in an inner wall, for generating cool air by the evaporator 18. The freezing chamber F maintaining about −18° C. by sucking most of the cool air, and the refrigerating chamber R maintaining about 0 to 7° C. by sucking part of the cool air are disposed side by side at both sides of a main body 2.

The refrigeration cycle includes basic components, and thus explanations thereof are omitted.

Here, the freezing chamber F and the refrigerating chamber R are divided by a cross wall 4. Part of the cross wall 4 is opened so that the cool air can flow between the freezing chamber F and the refrigerating chamber R.

The evaporator 18 is installed on the inner wall in the freezing chamber F, and a blast fan 22 is installed at the upper portion of the evaporator 18, for sending cool air generated in the evaporator 18 to the freezing chamber F or the refrigerating chamber R. Generally, an axial flow fan for sucking and discharging cool air in an axial direction is used.

The freezing chamber F and the refrigerating chamber R compose a cool air circulation structure for circulating cool air near the evaporator 18 through the freezing chamber F and the refrigerating chamber R by the operation of the blast fan 22, and returning the cool air to the evaporator 18.

The operations of the components of the refrigerator are controlled by a microcomputer (not shown). The microcomputer controls the whole components so that a temperature Tf of the freezing chamber F and a temperature Tr of the refrigerating chamber R can reach a set freezing temperature $Tf_0$ and a set refrigerating temperature $Tr_0$ setting by the user or automatically set.

In the conventional refrigerator, when a load is applied, the compressor 12 is operated according to a control signal from the microcomputer, and refrigerants are circulated though the compressor 12, the condenser 14, the expansion valve 16 and the evaporator 18, for cooling air near the evaporator 18 and generating cool air.

In addition, the blast fan 22 is operated according to a control signal from the microcomputer, so that most of the cool air near the evaporator 18 can be supplied to the freezing chamber F and part of the cool air can be supplied to the refrigerating chamber R. The cool air circulated in the freezing chamber F and the refrigerating chamber R to have a high temperature is resupplied to the evaporator 18.

In the conventional refrigerator, one evaporator 18 is installed in the freezing chamber F, and the cool air heat-exchanged through the evaporator 18 is partially distributed and supplied to the refrigerating chamber R on the passage of the freezing chamber F. Accordingly, when the inside temperature of any one of the freezing chamber F and the refrigerating chamber R does not satisfy the set freezing temperature $Tf_0$ or the set refrigerating temperature $Tr_0$, the compressor 12 and the blast fan 22 are operated to lower the temperature, thereby increasing power consumption or supercooling food.

For example, when the temperature Tf of the freezing chamber F reaches the set freezing temperature $Tf_0$, if the temperature Tr of the refrigerating chamber R does not satisfy the set refrigerating temperature $Tr_0$, the temperature Tr of the refrigerating chamber R must be lowered to reach the set refrigerating temperature $Tr_0$ by operating the compressor 12 and the blast fan 22. Here, the cool air is also supplied to the freezing chamber F, to unnecessarily lower the temperature Tf of the freezing chamber F. In addition, power consumption increases.

On the other hand, when the temperature Tr of the refrigerating chamber R reaches the set refrigerating temperature $Tr_0$, if the temperature Tf of the freezing chamber F does not satisfy the set freezing temperature $Tf_0$, the temperature Tf of the freezing chamber F must be lowered to reach the set freezing temperature $Tf_0$ by operating the compressor 12 and the blast fan 22. The cool air is also supplied to the refrigerating chamber R, to unnecessarily lower the temperature Tr of refrigerating chamber R. Moreover, food is supercooled.

In the conventional refrigerator, part of the cool air from the evaporator 18 is distributed to the refrigerating chamber R. A volume of the cool air distributed to the refrigerating chamber R is relatively smaller than a volume of the cool air distributed to the freezing chamber F. Therefore, a cooling speed of the refrigerating chamber R is reduced, to unnecessarily operate the compressor 12.

For example, when the temperature Tr of the refrigerating chamber R does not reach the set refrigerating temperature $Tr_0$, the compressor 12 is operated until the temperature Tr of the refrigerating chamber R reaches the set refrigerating temperature $Tr_0$. Accordingly, an excessive load is applied to the compressor 12 to reduce the temperature of the evaporator 18 lower than the temperature Tf of the freezing chamber F.

DISCLOSURE OF THE INVENTION

The present invention is achieved to solve the above problems. An object of the present invention is to provide a refrigerator which can improve cooling efficiency and reduce power consumption, by individually cooling a freezing chamber and a refrigerating chamber, and a method for controlling an operation of the same.

Another object of the present invention is to provide a refrigerator which can prevent a compressor from being unnecessarily operated, by increasing a cooling speed of a refrigerating chamber as well as a cooling speed of a freezing chamber so that a temperature of the refrigerating chamber can rapidly reach a set refrigerating temperature, and a method for controlling an operation of the same.

Yet another object of the present invention is to provide a refrigerator which can increase an inside capacity of a freezing chamber or a refrigerating chamber, and a method for controlling an operation of the same.

Yet another object of the present invention is to provide a refrigerator which can prevent an evaporator from being frosted and effectively perform a defrosting operation, and a method for controlling an operation of the same.

In order to achieve the above-described objects of the present invention, there is provided a refrigerator including: a compressor for compressing refrigerants into high temperature high pressure gas refrigerants; a condenser for condensing the refrigerants compressed in the compressor into high temperature high pressure liquid refrigerants; a decompression means for expanding the refrigerants condensed in the condenser into low temperature low pressure liquid refrigerants; an evaporator for evaporating the refrigerants expanded in the decompression means into low temperature low pressure gas refrigerants, a heat exchange region of which being divided into a freezing chamber side region and a refrigerating chamber side region; and an air blast device linked respectively to the freezing chamber side region and the refrigerating chamber side region of the evaporator, for sending cool air from each region to a freezing chamber and a refrigerating chamber.

According to another aspect of the present invention, a method for controlling an operation of a refrigerator includes: a first step for compressing refrigerants into high temperature high pressure gas refrigerants according to a freezing load or a refrigerating load applied to a freezing chamber or a refrigerating chamber, a second step for condensing the refrigerants compressed in the first step into high temperature high pressure liquid refrigerants by performing a heat exchange operation with air; a third step for decompressing the refrigerants condensed in the second step into low temperature low pressure liquid refrigerants by controlling a decompression degree according to the load; and a fourth step for generating cool air by evaporating the refrigerants decompressed in the third step into low temperature low pressure gas refrigerants by performing a heat exchange operation with air, and selectively sending the cool air to the freezing chamber, the refrigerating chamber, or both the freezing chamber and the refrigerating chamber according to the load.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A refrigerator and a method for controlling an operation of the same in accordance with the present invention will now be described in detail with reference to the accompanying drawings.

Figure 1:
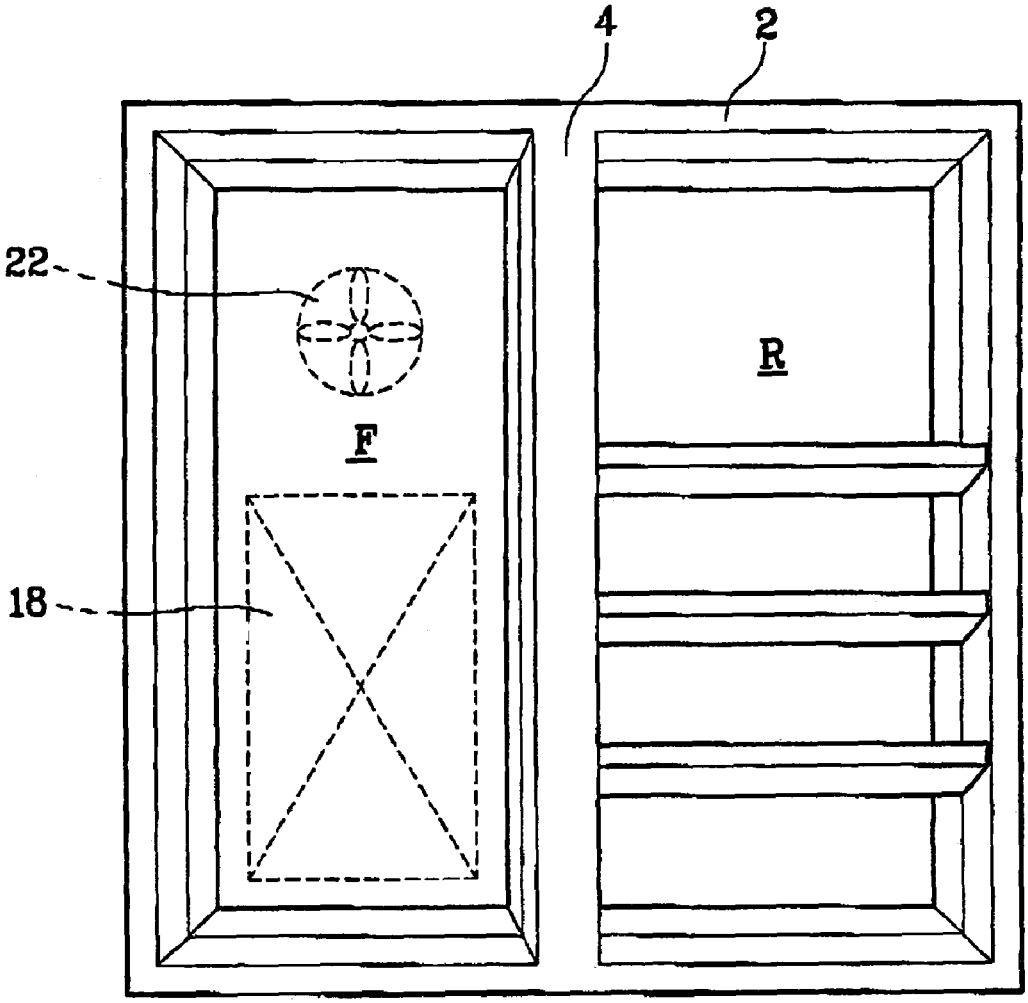
FIG. 1 is a schematic front perspective view illustrating a conventional side-by-side type refrigerator.
Figure 2:
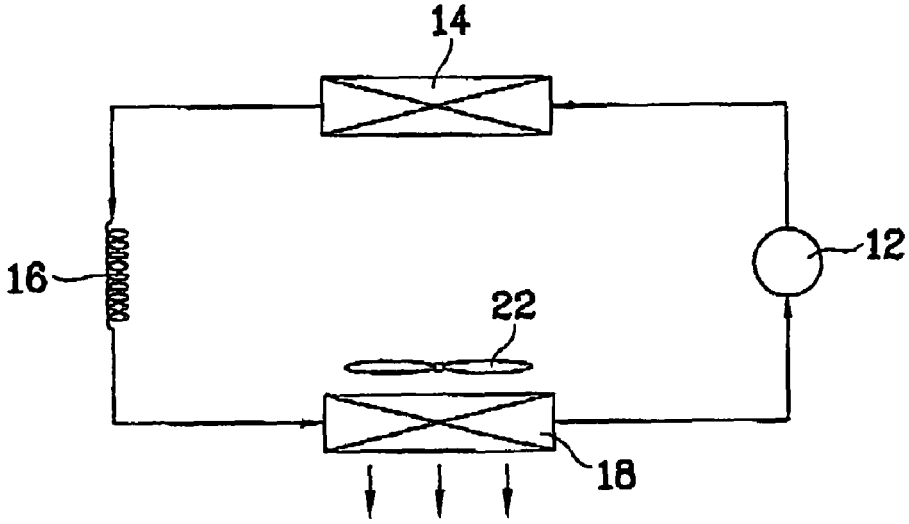
FIG. 2 is a structure view illustrating a refrigeration cycle applied to the refrigerator of FIG. 1.
Figure 3:
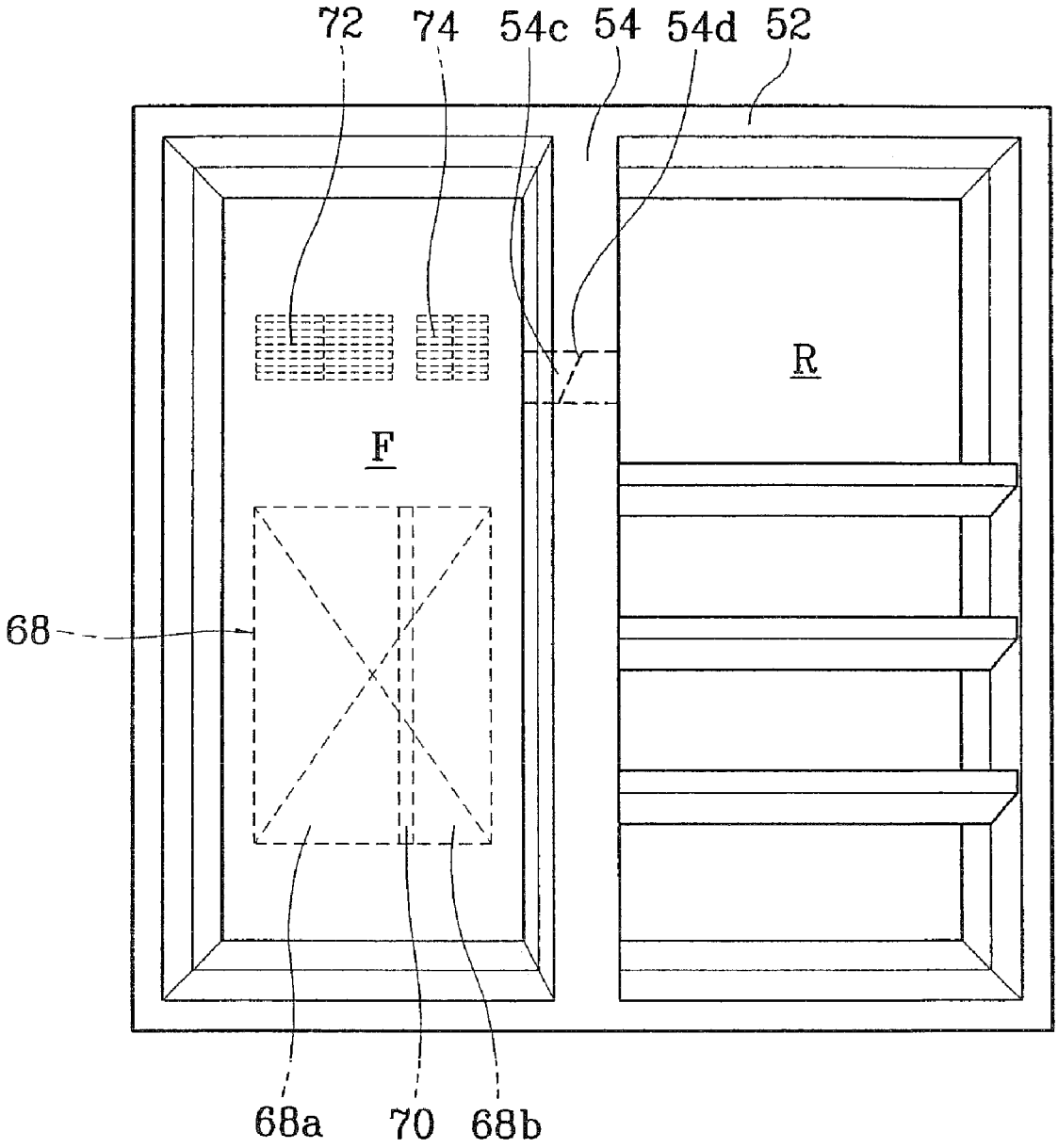
FIG. 3 is a front perspective view illustrating a side-by-side type refrigerator in accordance with a first embodiment of the present invention.
Figure 4:
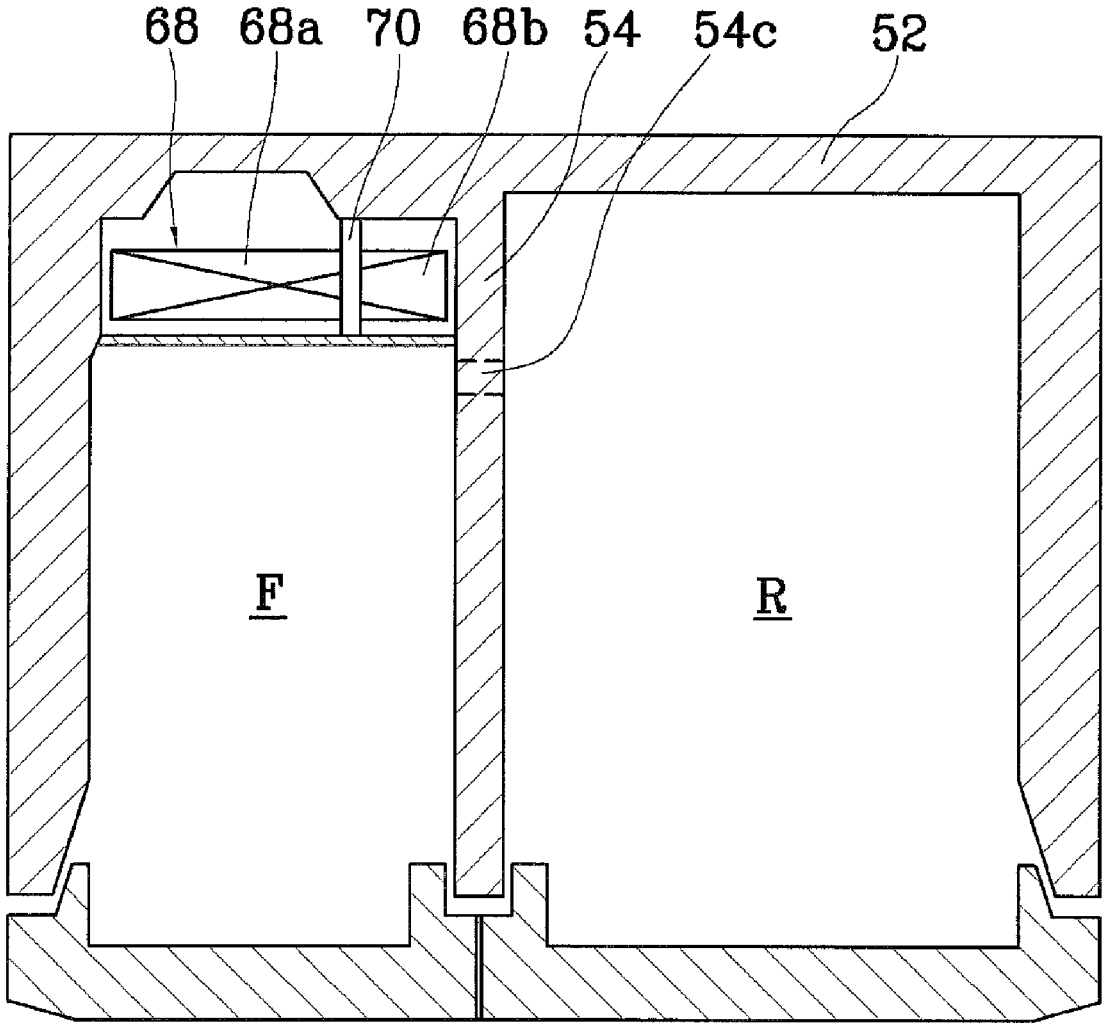
FIG. 4 is a cross-sectional view illustrating the refrigerator of FIG. 3.

FIG. 3 is a front perspective view illustrating a side-by-side type refrigerator in accordance with a first embodiment of the present invention, and FIG. 4 is a cross-sectional view illustrating the refrigerator of FIG. 3.

The refrigerator in accordance with the first embodiment of the present invention will now be described with reference to FIGS. 3 and 4. A freezing chamber F and a refrigerating chamber R are disposed side by side at both sides of a main body 52 from a cross wall 54. A compressor (not shown), a condenser (not shown) and an expansion means (not shown) are built in a machine room (not shown) formed at one side of the freezing chamber F and the refrigerating chamber R. An evaporator 68 is built in the freezing chamber F, for generating cool air by performing a heat exchange operation with refrigerants.

Especially, the evaporator 68 is divided into a freezing chamber side region 68*a* and a refrigerating chamber side region 68*b*. Individual circulation passages are formed to circulate the cool air heat-exchanged in each region in the freezing chamber F and the refrigerating chamber R, respectively. A freezing chamber fan 72 and a refrigerating chamber fan 74 for sending the cool air from the freezing chamber side region 68*a* and the refrigerating chamber side region 68*b* to the freezing chamber F and the refrigerating chamber R, respectively, and motors (not shown) for driving the fans 72 and 74 are installed on the circulation passages to be linked to the freezing chamber side region 68*a* and the refrigerating chamber side region 68*b*.

Preferably, the compressor is a capacity variable compressor such as an inverter compressor or a linear compressor to control a compression flow rate, and the expansion means is a capillary tube having a relatively small refrigerant tube diameter or an electronic expansion valve controlling opening.

In the evaporator 68, a heat exchange region is divided by a special blocking plate 70 so that the freezing chamber side region 68*a* and the refrigerating chamber side region 68*b* can be disposed side by side.

Figure 10:
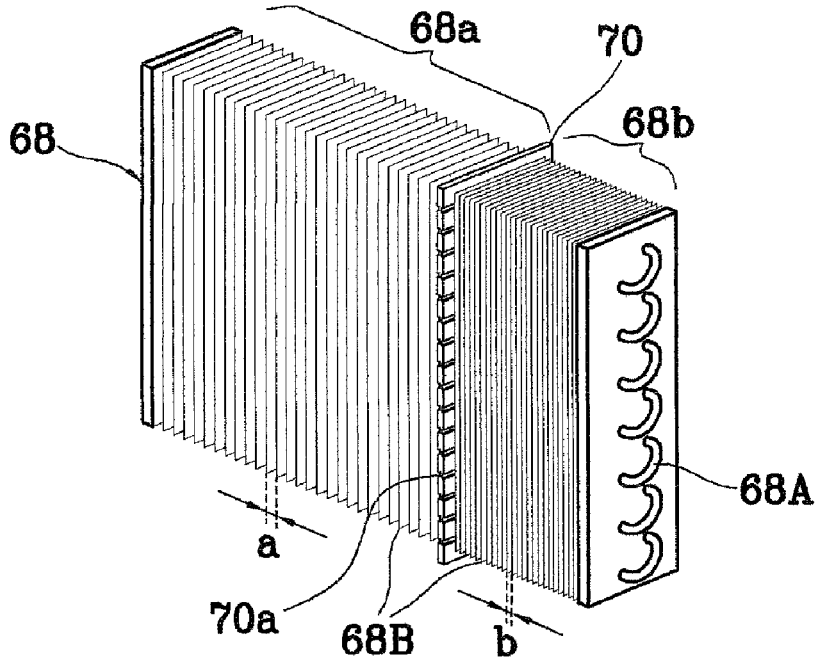
FIG. 10 is a perspective view illustrating a first example of an evaporator applied to the refrigerators of FIGS. 3 and 5.
Figure 11:
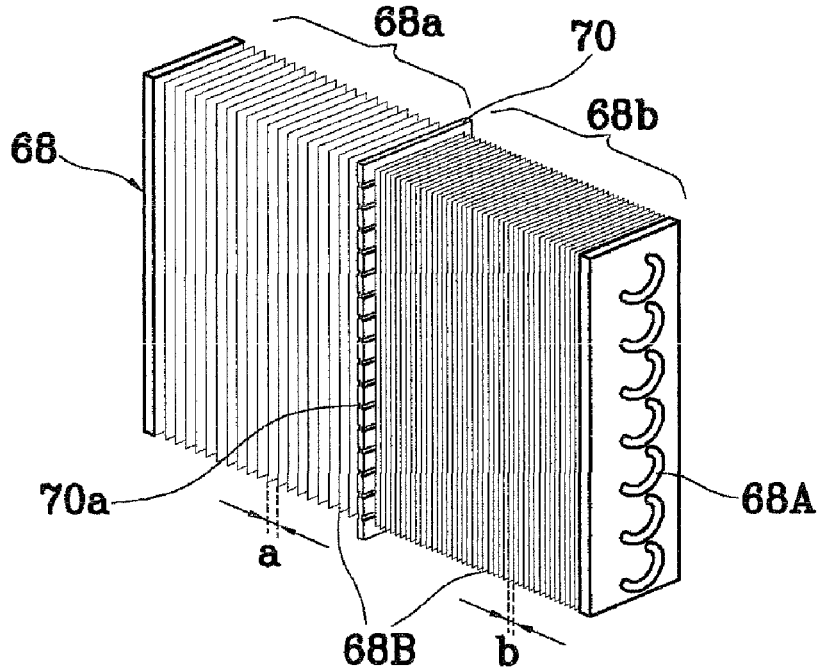
FIG. 11 is a perspective view illustrating a second example of the evaporator applied to the refrigerators of FIGS. 3 and 5.

Here, the evaporator 68 is a straight type thin heat exchanger in which a plurality of cooling fins 68B are installed vertically to a refrigerant tube 68A. The blocking plate 70 is installed between the cooling fins 68B. As shown in FIGS. 10 and 11, plurality of grooves 70*a* are formed on the surface of the blocking plate 70, for forming a turbulent bed to the cool air flowing along the surface of the evaporator 68, thereby improving heat exchange efficiency.

As shown in FIG. 11, in the evaporator 68, the freezing chamber side region 68*a* and the refrigerating chamber side region 68*b* an have the same area. Generally, in order to maintain the freezing chamber F at a lower temperature than the refrigerating chamber R, lower temperature cool air is necessary in the freezing chamber F. Accordingly, as depicted in FIG. 10, the freezing chamber side region 68*a* is preferably larger than the refrigerating chamber side region 68*b*.

In addition, in the evaporator 68, the freezing chamber side region 68*a* maintains a lower temperature than the refrigerating chamber side region 68*b*, and thus is more easily frosted than the refrigerating chamber side region 68*b*. Therefore, a cooling fin pitch a of the freezing chamber side region 68*a* is set wider than a cooling fin pitch b of the refrigerating chamber side region 68*b*, to efficiently prevent frost.

The refrigerating chamber side region 68*b* is narrower than the freezing chamber side region 68*a*, to reduce heat exchange efficiency. Here, the cooling fan pitch b of the refrigerating chamber side region 68*b* is narrower than the cooling fan pitch a of the freezing chamber side region 68*a*. Accordingly, more cooling fins are installed in a unit area of the refrigerating chamber side region 68*b*, thereby improving heat exchange efficiency in the refrigerating chamber side region 68*b*.

Preferably, at least one defrosting heater (not shown) is installed at the lower portion of the evaporator 68, for performing a defrosting operation. A defrosting heater (not shown) for the freezing chamber F is installed at the lower portion of the freezing chamber side region 68*a*, for defrosting the freezing chamber side region 68*a*, and a defrosting heater (not shown) for the refrigerating chamber R is installed at the lower portion of the refrigerating chamber side region 68*b*, for defrosting the refrigerating chamber side region 68*b*.

Preferably, the defrosting heater for the freezing chamber F and the defrosting heater for the refrigerating chamber R are radiant heaters for transmitting heat to the evaporator 68 by radiation. The defrosting heater for the freezing chamber F has a larger capacity than the defrosting heater for the refrigerating chamber R, thereby rapidly defrosting the freezing chamber side region 68*a*.

The freezing chamber fan 72 and the refrigerating chamber fan 74 are disposed side by side at the upper portions of the freezing chamber side region 68*a* and the refrigerating chamber side region 68*b*, for sending the refrigerants from the evaporator 68 to the freezing chamber F and the refrigerating chamber R, respectively. Recently, as a large volume of cool air is required due to increase of a capacity of the refrigerator, sirocco fans which are centrifugal fans which have a relatively large air blast volume and which can be effectively installed in a restricted space of the upper portion of the evaporator 68 which is a thin heat exchanger are used as the freezing chamber fan 72 and the refrigerating chamber fan 74.

That is, the freezing chamber fan 72 and the refrigerating chamber fan 74 are sirocco fans for sucking air in an axial direction and discharging air in a radius direction. Therefore, the freezing chamber fan 72 and the refrigerating chamber fan 74 are disposed side by side at the upper portion of the evaporator 68 in an axial direction and installed on the individual circulation passages, respectively, so that the cool air from the evaporator 68 can be supplied to both sides of the freezing chamber fan 72 and the refrigerating chamber fan 74 and discharged to the front surface thereof.

Preferably, the motors for driving the freezing chamber fan 72 and the refrigerating chamber fan 74 are BLDC motors. Because the BLDC motor uses a driving circuit for converting an alternating current to a direct current instead of using a brush, the BLDC motor does not generate a spark by a carbon material brush, prevents gas explosion, is stably driven in most of rotation numbers, and maintains high efficiency of 70 to 80%.

In accordance with the first embodiment of the present invention, there are formed the circulation passage for the freezing chamber F for discharging the cool air from the freezing chamber side region 68*a* of the evaporator 68 to the freezing chamber F, circulating the cool air in the freezing chamber F, and re-supplying the circulated air to the freezing chamber side region 68*a* of the evaporator 68, and the circulation passage for the refrigerating chamber R for discharging the cool air from the refrigerating chamber side region 68*b* of the evaporator 68 to the refrigerating chamber R, circulating the cool air in the refrigerating chamber R, and re-supplying the circulated air to the refrigerating chamber side region 68*b*.

Here, the evaporator 68 is installed on the inner wall of the freezing chamber F. Accordingly, the circulation passage for the refrigerating chamber R including a suction passage for the refrigerating chamber R and a discharge passage for the refrigerating chamber R is formed between the refrigerating chamber side region 68*b* and the refrigerating chamber R, and the circulation passage for the freezing chamber F is automatically formed in the other regions.

The cool air is individually circulated in the freezing chamber F and the refrigerating chamber R to efficiently cool the freezing chamber F and the refrigerating chamber R. Even if a door of the freezing chamber F or the refrigerating chamber R is opened/closed, the other door is not moved.

On the other hand, a connection passage 54*c* is formed on the cross wall 54 between the freezing chamber F and the refrigerating chamber R, so that the cool air can flow therethrough. A damper 54*d* is installed to be opened/closed on the connection passage. The damper 54*d* is opened/closed by the microcomputer for controlling the operation of the refrigerator, for supplying part of the cool air of the freezing chamber F to the refrigerating chamber R.

Figure 5:
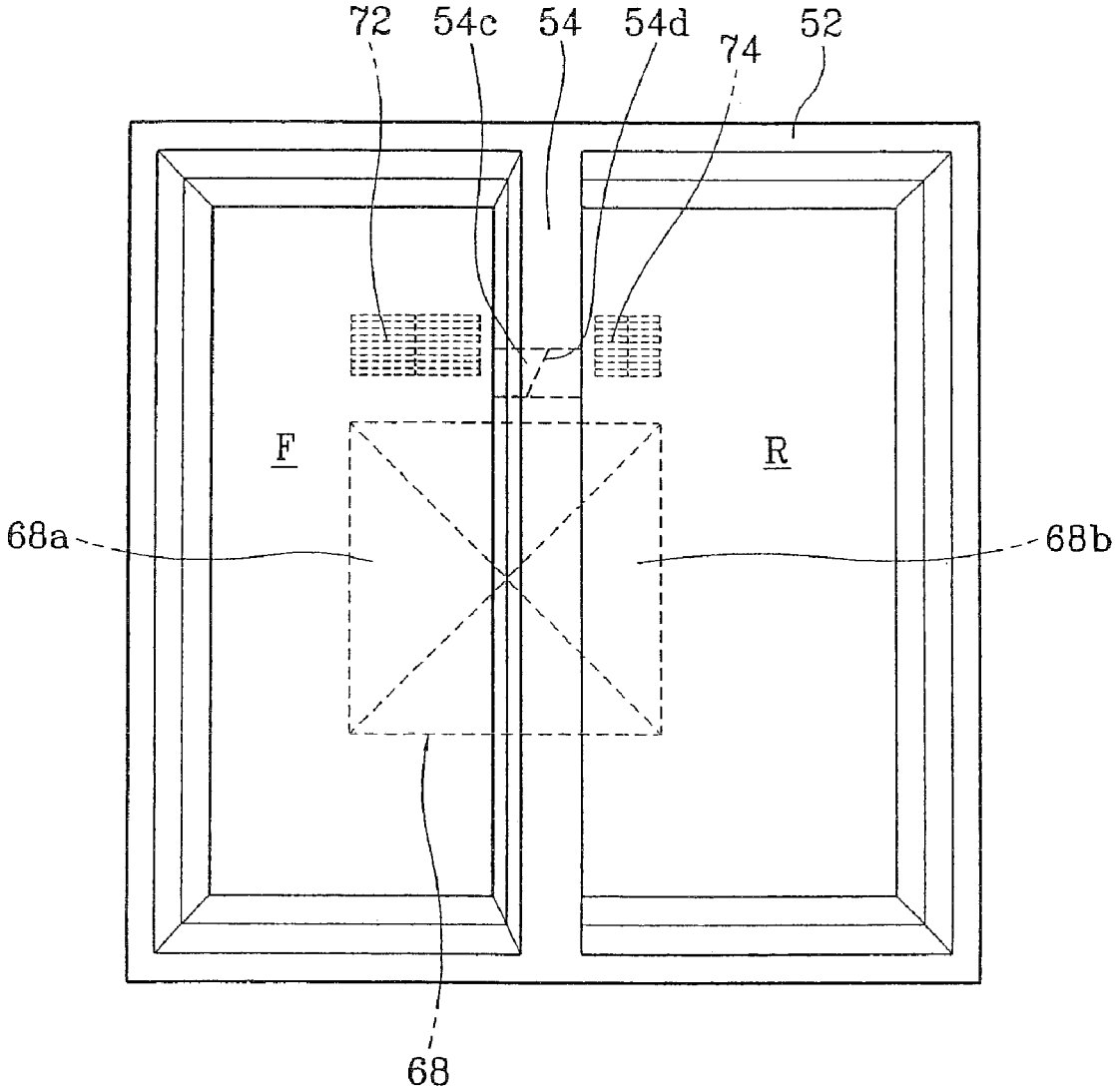
FIG. 5 is a front perspective view illustrating a side-by-side type refrigerator in accordance with a second embodiment of the present invention.
Figure 6:
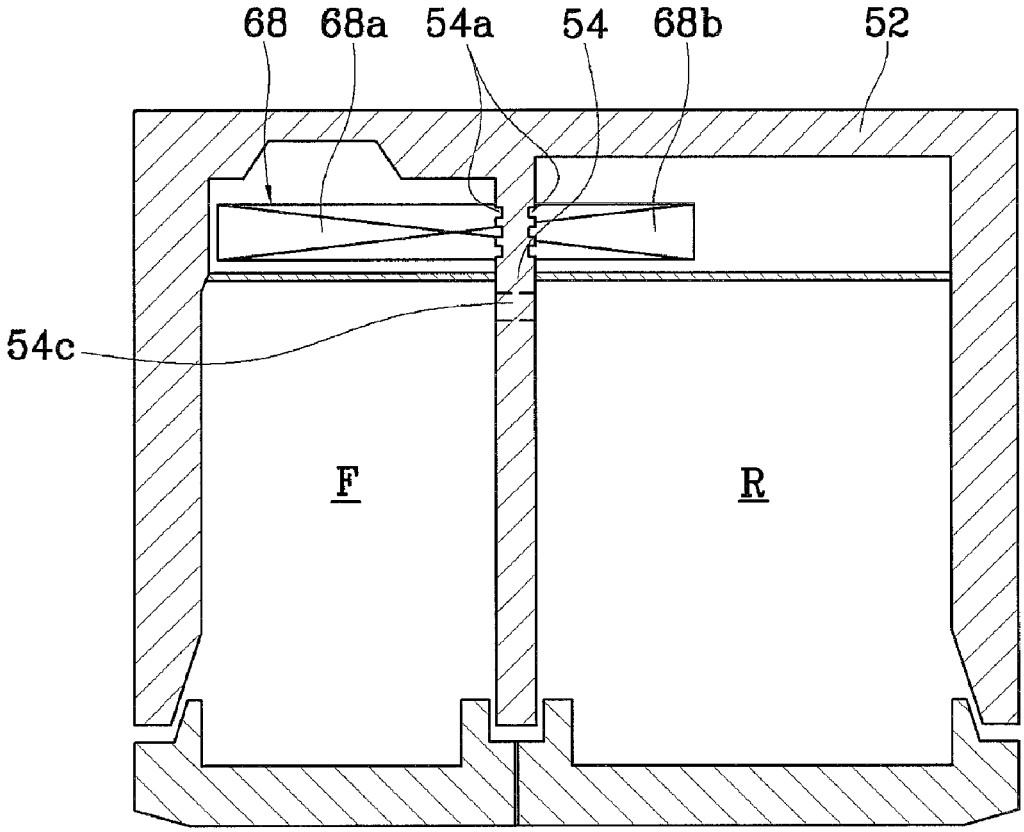
FIG. 6 is a cross-sectional view illustrating the refrigerator of FIG. 5.

FIG. 5 is a front perspective view illustrating a side-by-side type refrigerator in accordance with a second embodiment of the present invention, and FIG. 6 is a cross-sectional view illustrating the refrigerator of FIG. 5.

The refrigerator in accordance with the second embodiment of the present invention will now be explained with reference to FIGS. 5 and 6. Identically to the first embodiment, a freezing chamber F and a refrigerating chamber R are disposed side by side at both sides of a main body 52 from a cross wall 54. A compressor (not shown), a condenser (not shown) and an expansion means (not shown) are built in a machine room (not shown) formed at one side of the freezing chamber F and the refrigerating chamber R. An evaporator 68 is built in the freezing chamber F and the refrigerating chamber R for generating cool air by performing a heat exchange operation with refrigerants.

Especially, the evaporator 68 is divided into a freezing chamber side region 68*a* and a refrigerating chamber side region 68*b* by the cross wall 54. Individual circulation passages are formed to circulate the cool air heat-exchanged in each region in the freezing chamber F and the refrigerating chamber R, respectively. A freezing chamber fan 72 and a refrigerating chamber fan 74 for sending the cool air from the freezing chamber side region 68*a* and the refrigerating chamber side region 68*b* to the freezing chamber F and the refrigerating chamber R, respectively, and motors (not shown) for driving the fans 72 and 74 are installed on the circulation passages to be linked to the freezing chamber side region 68*a* and the refrigerating chamber side region 68*b*.

Preferably, the compressor and the expansion means are formed in the same manner as those of the first embodiment.

In the evaporator 68, a heat exchange region is divided by the cross wall 54 so that the freezing chamber side region 68*a* and the refrigerating chamber side region 68*b* can be disposed side by side. As shown in FIG. 6, plurality of grooves 54*a* are formed on the surface of the cross wall 54, for forming a turbulent bed to the cool air flowing along the surface of the evaporator 68, thereby improving heat exchange efficiency.

The evaporator 68 is a straight type thin heat exchanger in which a plurality of cooling fins 68B are installed vertically to a refrigerant tube 68A. As shown in FIG. 11, the freezing chamber side region 68*a* and the refrigerating chamber side region 68*b* can have the same area, or as depicted in FIG. 10, the freezing chamber side region 68*a* can be larger than the refrigerating chamber side region 68*b*. A cooling fin pitch a of the freezing chamber side region 68*a* is set wider than a cooling fin pitch b of the refrigerating chamber side region 68*b*, to efficiently prevent the freezing chamber side region 68*a* from being frosted and improve heat exchange efficiency in the refrigerating chamber side region 68*b*.

Preferably, at least one defrosting heater (not shown) is installed at the lower portion of the evaporator 68, for performing a defrosting operation. The defrosting heaters are also formed in the same manner as those of the first embodiment.

The frying chamber fan 72, the refrigerating chamber fan 74, and the motors for driving the fans 72 and 74 are formed in the same manner as those of the first embodiment.

In accordance with the second embodiment of the present invention, there are formed the circulation passage for the freezing chamber F for discharging the cool air from the freezing chamber side region 68*a* of the evaporator 68 to the freezing chamber F, circulating the cool air in the freezing chamber F, and re-supplying the circulated air to the freezing chamber side region 68*a* of the evaporator 68, and the circulation passage for the refrigerating chamber R for discharging the cool air from the refrigerating chamber side region 68*b* of the evaporator 68 to the refrigerating chamber R, circulating the cool air in the refrigerating chamber R, and re-supplying the circulated air to the refrigerating chamber side region 68*b*.

In the evaporator 68, the freezing chamber side region 68*a* is disposed on the inner wall of the freezing chamber F, and the refrigerating chamber side region 68*b* is disposed on the inner wall of the refrigerating chamber R. Here, the freezing chamber side region 68*a* and the refrigerating chamber side region 68*b* are divided by the cross wall 54. Accordingly, the circulation passage for the freezing chamber F and the circulation passage for the refrigerating chamber R need not to be specially divided.

A connection passage 54*c* is formed on the cross wall 54 between the freezing chamber F and the refrigerating chamber R, so that the cool air can flow therethrough. A damper 54*d* is installed to be opened/closed on the connection passage 54*c*. The damper 54*d* is opened/closed by the microcomputer for controlling the operation of the refrigerator, for supplying part of the cool air of the freezing chamber F to the refrigerating chamber R.

Figure 7:
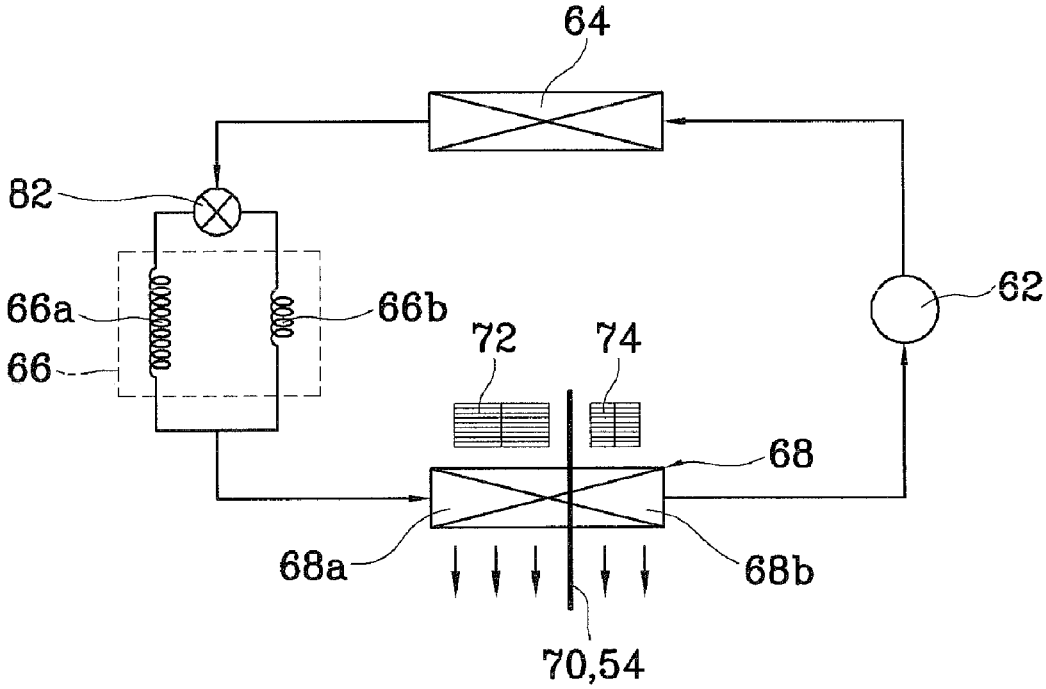
FIG. 7 is a structure view illustrating a first example of a refrigeration cycle applied to the refrigerators of FIGS. 3 and 5.

FIG. 7 is a structure view illustrating a first example of a refrigeration cycle applied to the refrigerators of FIGS. 3 and 5.

The first example of the refrigeration cycle which can be applied to the refrigerators in accordance with the first and second embodiments of the present invention will now be explained. The refrigeration cycle includes a compressor 62 for compressing refrigerants into high temperature high pressure gas refrigerants, a condenser 64 for condensing the refrigerants compressed in the compressor 62 into high temperature high pressure liquid refrigerants by performing a heat exchange operation with outdoor air, an expansion means 66 having a freezing expansion valve 66*a* or a refrigerating expansion valve 66*b* for decompressing the refrigerants condensed in the condenser 64 into low temperature low pressure liquid refrigerants by controlling a decompression degree according to a load, a three way valve 82 for controlling the refrigerants discharged from the condenser 64 to be selectively supplied to the freezing expansion valve 66*a* or the refrigerating expansion valve 66*b*, and an evaporator 68 for evaporating the refrigerants decompressed in the expansion means 66 into low temperature low pressure gas refrigerants by performing a heat exchange operation with air in a freezing chamber F or a refrigerating chamber R, and generating cool air at the same time.

The evaporator 68 is divided into a freezing chamber side region 68*a* and a refrigerating chamber side region 68*b*. A freezing chamber fan 72 and a motor are installed to be linked to the freezing chamber side region 68*a*, so that the cool air passing through the freezing chamber side region 68*a* can be supplied merely to the freezing chamber F. A refrigerating chamber fan 74 and a motor are installed to be linked to the refrigerating chamber side region 68*b*, so that the cool air passing through the refrigerating chamber side region 68*b* can be supplied merely to the refrigerating chamber R.

In detail, a constant speed compressor can be used as the compressor 62. However, the compressor 62 is preferably a capacity variable compressor for controlling a flow rate of the refrigerants circulated in the refrigeration cycle and controlling a compression degree of the refrigerants. For example, an inverter compressor or a linear compressor which can vary a rotation number is used as the compressor 62.

The condenser 64 is a heat exchanger. In order efficiently perform the heat exchange operation with outdoor air, a special fan (not shown) can be installed adjacently to the condenser 64.

The freezing expansion valve 66*a* and the refrigerating expansion valve 66*b* are disposed side by side. Refrigerant tubes formed at the front and rear ends of the freezing expansion valve 66*a* and the refrigerating expansion valve 66*b* are coupled to each other, respectively. Capillary tubes having a relatively small refrigerant tube diameter or electronic expansion valves controlling opening can be used.

Here, the freezing expansion valve 66*a* and the refrigerating expansion valve 66*b* are different in capacity. The freezing expansion valve 66*a* has a relatively larger decompression capacity than the refrigerating expansion valve 66*b*. The freezing expansion valve 66*a* and the refrigerating expansion valve 66*b* can switch the passages of the refrigerants according to each load.

The three way valve 82 controls the refrigerants from the condenser 64 to be supplied in one direction of the freezing expansion valve 66*a* or the refrigerating expansion valve 66*b*. Preferably, the three way valve 82 is installed on the refrigerant tubes branched into the freezing expansion valve 66*a* and the refrigerating expansion valve 66*b*.

Here, the three way valve 82 controls the refrigerants to pass through the freezing expansion valve 66*a* so that a temperature Tf of the freezing chamber F can reach a set freezing temperature $Tf_0$, and controls the refrigerants to pass through the refrigerating expansion valve 66*b* so that a temperature Tr of the refrigerating chamber R can reach a set refrigerating temperature $Tr_0$.

The evaporator 68 is installed so that the freezing chamber region 66*a* and the refrigerating chamber side region 68*b* can be linked to the freezing chamber F and the refrigerating chamber R, respectively. The freezing chamber fan 72, the refrigerating chamber fan 74, and the motors for driving the fans 72 and 74 are installed on each passage.

Preferably, the evaporator 68 is a straight type thin heat exchanger, the freezing chamber fan 72 and the refrigerating chamber fan 74 are sirocco fans, and the motors are BLCD motors.

While the compressor 62 is operated, the low temperature low pressure gas refrigerants are circulated in the freezing chamber side region 68*a* and the refrigerating chamber side region 68*b* of the evaporator 68. Accordingly, the cool air is supplied to the freezing chamber F or the refrigerating chamber R according to the operations of the freezing chamber fan 72 and the refrigerating chamber fan 74.

Here, the freezing chamber fan 72 sends the cool air from the freezing chamber side region 68*a* to the freezing chamber F so that the temperature Tf of the freezing chamber F can reach the set freezing temperature $Tf_0$, and the refrigerating chamber fan 74 sends the cool air from the refrigerating chamber side region 68*b* to the refrigerating chamber R so that the temperature Tr of the refrigerating chamber R can reach the set refrigerating chamber $Tr_0$.

The evaporator 68 is formed to individually link the freezing chamber side region 68*a* and the refrigerating chamber side region 68*b* to the freezing chamber F and the refrigerating chamber R, and to have circulation passages for circulating cool air in the freezing chamber F and the refrigerating chamber R, respectively.

The operations of the above-described components are controlled by a microcomputer (not shown).

The operation of the first example of the refrigeration cycle will now be described.

In a freezing mode for making the temperature Tf of the freezing chamber F reach the set freezing temperature $Tf_0$, the microcomputer controls the three way valve 82 so that the refrigerants can pass through the freezing expansion valve 66*a*, operates the freezing chamber fan 72, and stops the refrigerating chamber fan 74.

Therefore, the refrigerants are circulated through the compressor 62, the condenser 64, the freezing expansion valve 66*a* and the evaporator 68. As the freezing chamber fan 72 is operated, the cool air heat-exchanged in the freezing chamber side region 68*a* is supplied merely to the freezing chamber F, to cool the freezing chamber F.

In a refrigerating mode for making the temperature Tr of the refrigerating chamber R reach the set refrigerating temperature $Tr_0$, the microcomputer controls the three way valve 82 so that the refrigerants can pass through the refrigerating expansion valve 66*b*, operates the refrigerating chamber fan 74, and stops the freezing chamber fan 74.

Accordingly, the refrigerants are circulated through the compressor 62, the condenser 64, the refrigerating expansion valve 66*b* and the evaporator 68. As the refrigerating chamber fan 74 is operated, the cool air heat-exchanged in the refrigerating chamber side region 68*b* is supplied merely to the refrigerating chamber R, to cool the refrigerating chamber R.

In a freezing and refrigerating mode for making the temperature Tf of the freezing chamber F and the temperature Tr of the refrigerating chamber R reach the set freezing temperature $Tf_0$ and the set refrigerating temperature $Tr_0$, respectively, the three way valve 82 makes the refrigerants to pass through the freezing expansion valve 66*a*, the freezing chamber fan 72 is continuously operated, and the refrigerating chamber fan 74 is operated and stopped at intervals of a predetermined time.

As a result, the refrigerants are circulated through the compressor 62, the condenser 64, the freezing expansion valve 66*a* and the evaporator 68. As the freezing chamber fan 72 is operated, the cool air heat-exchanged in the freezing chamber side region 68*a* is supplied to the freezing chamber F, and as the refrigerating chamber fan 74 is intermittently operated, the cool air heat-exchanged in the refrigerating chamber side region 68*b* is supplied to the refrigerating chamber R during the operation, thereby cooling both the freezing chamber F and the refrigerating chamber R.

In a defrosting mode for making the temperature Tf of the freezing chamber F and the temperature Tr of the refrigerating chamber R reach a defrosting temperature Ti for removing ice from the surface of the evaporator 68, the compressor 62 is stopped, the freezing chamber fan 72 is stopped, and the refrigerating chamber fan 74 is operated.

In a state where the refrigerants are not circulated, the refrigerating chamber side region 68*b* of the evaporator 68 is defrosted by the air sent by the operation of the refrigerating chamber fan 74, and the freezing chamber side region 68*a* of the evaporator 68 is defrosted by the heat transmitted from the refrigerating chamber side region 68*b*.

In the defrosting mode, if the temperature Tf of the freezing chamber F and the temperature Tr of the refrigerating chamber R do not reach the defrosting temperature Ti, defrosting heaters installed at the lower portion of the evaporator 68 are heated to defrost the evaporator 68.

The first example of the refrigeration cycle improves the cooling speed of the refrigerating chamber R more than the general refrigeration cycle by cooling the freezing chamber F and the refrigerating chamber R, respectively, efficiently cools a large capacity of refrigerator, and individually effectively defrosts the freezing chamber F and the refrigerating chamber R.

Figure 8:
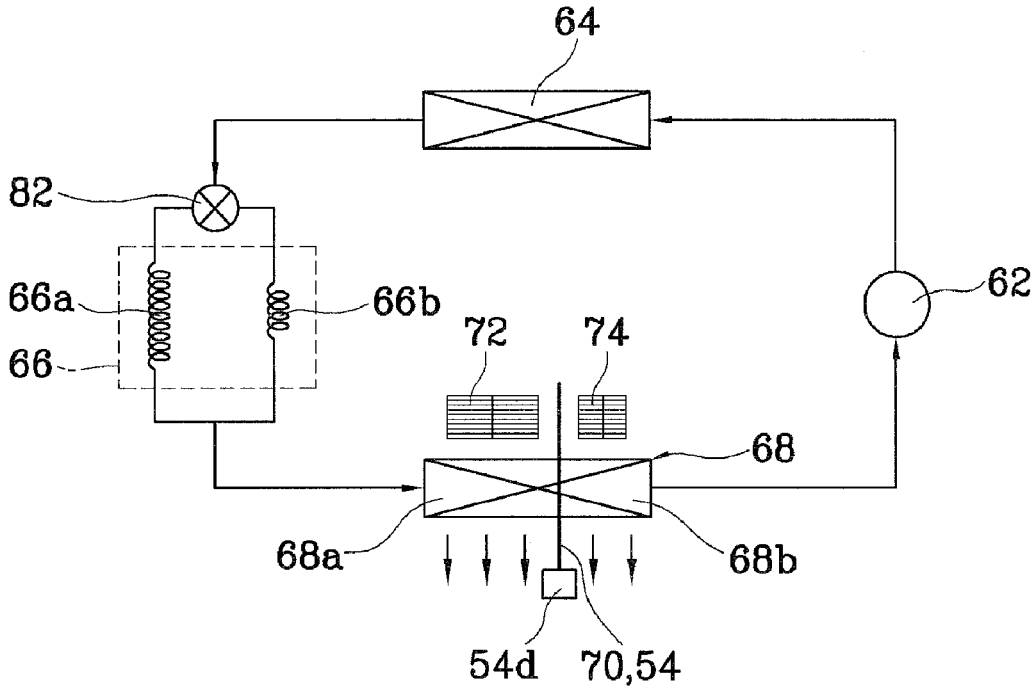
FIG. 8 is a structure view illustrating a second example of the refrigeration cycle applied to the refrigerators of FIGS. 3 and 5.

FIG. 8 is a structure view illustrating a second example of the refrigeration cycle applied to the refrigerators of FIGS. 3 and 5.

The second example of the refrigeration cycle which can be applied to the refrigerators in accordance with the first and second embodiments of the present invention will now be explained. The second example of the refrigeration cycle is basically identical to the first example of the refrigeration cycle. However, a connection passage (not shown) is formed between the freezing chamber F and the refrigerating chamber R, so that the cool air can flow therethrough, and a damper 76 is installed to be opened/closed on the connection passage.

Accordingly, the second example of the refrigeration cycle is operated in the same manner as the first example of the refrigeration cycle. However, in the freezing mode, if the temperature Tr of the refrigerating chamber R is higher than the set refrigerating temperature $Tr_0$, the damper 76 is opened to supply part of the cool air of the freezing chamber F to the refrigerating chamber R, thereby controlling the temperature Tr of the refrigerating chamber R.

That is, when the temperature Tr of the refrigerating chamber R increases in the freezing mode, the temperature Tr of the refrigerating chamber R can be easily controlled by supplying the cool air of the freezing chamber F having a relatively low temperature to the refrigerating chamber R. Therefore, the refrigerating chamber fan 74 needs not to be driven, which results in low power consumption.

Figure 9:
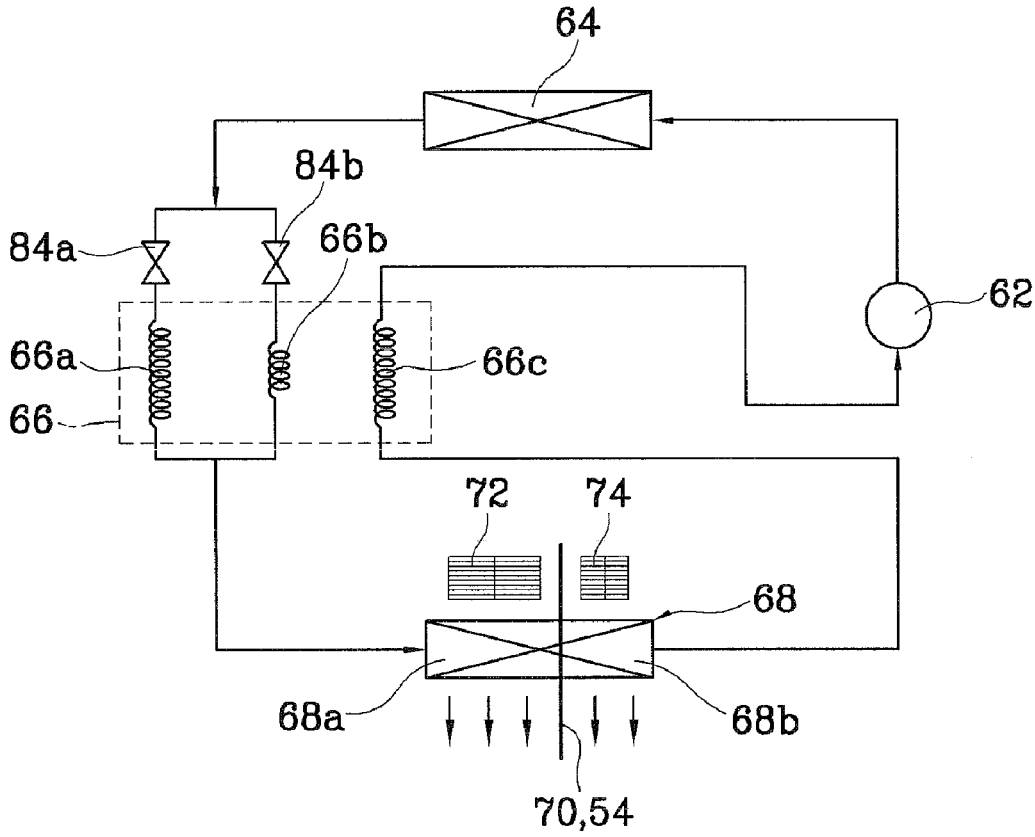
FIG. 9 is a structure view illustrating a third example of the refrigeration cycle applied to the refrigerators of FIGS. 3 and 5.

FIG. 9 is a structure view illustrating a third example of the refrigeration cycle applied to the refrigerators of FIGS. 3 and 5.

The third example of the refrigeration cycle which can be applied to the refrigerators in accordance with the first and second embodiments of the present invention will now be explained. The refrigeration cycle includes a compressor 62 for compressing refrigerants into high temperature high pressure gas refrigerants, a condenser 64 for condensing the refrigerants compressed in the compressor 62 into high temperature high pressure liquid refrigerants by performing a heat exchange operation with outdoor air, an expansion means 66 having a freezing expansion valve 66*a* or a refrigerating expansion valve 66*b* for decompressing the refrigerants condensed in the condenser 64 into low temperature low pressure liquid refrigerants by controlling a decompression degree according to a load, first and second solenoid valves 84*a* and 84*b* installed on refrigerant tubes formed at the front ends of the freezing expansion valve 66*a* and the refrigerating expansion valve 66*b*, respectively, for controlling the refrigerant tubes to be opened/closed, and an evaporator 68 for evaporating the refrigerants decompressed in the expansion means 66 into low temperature low pressure gas refrigerants by performing a heat exchange operation with air in a freezing chamber F or a refrigerating chamber R, and generating cool air at the same time.

The evaporator 68 is divided into a freezing chamber side region 68*a* and a refrigerating chamber side region 68*b*. A freezing chamber fan 72 and a motor are installed to be linked to the freezing chamber side region 68*a*, so that the cool air passing through the freezing chamber side region 68*a* can be supplied merely to the freezing chamber F. A refrigerating chamber fan 74 and a motor are installed to be linked to the refrigerating chamber side region 68*b*, so that the cool air passing through the refrigerating chamber side region 68*b* can be supplied merely to the refrigerating chamber R.

In detail, the compressor 62, the condenser 64, the freezing expansion valve 66*a*, the refrigerating expansion valve 66*b*, the evaporator 68, the freezing chamber fan 72 and the refrigerating chamber fan 74 are formed in the same manner as those of the first embodiment.

The expansion means 66 further includes an auxiliary expansion valve 66*c* for intermediately cooling the refrigerants from the evaporator 68 by decompression, and resupplying the refrigerants to the compressor 62. That is, the refrigerants are intermediately cooled between the evaporator 68 and the compressor 62, thereby improving efficiency of the whole refrigeration cycle.

The first and second solenoid valves 84*a* and 84*b* are installed on the refrigerant tubes at the front ends of the freezing expansion valve 66*a* and the refrigerating expansion valve 66*b*, for controlling the refrigerant tubes to be opened/closed. Therefore, the first and second solenoid valves 84*a* and 84*b* supply the refrigerants from the condenser 64 to the freezing expansion valve 66*a*, the refrigerating expansion valve 66*b*, or both the freezing expansion valve 66*a* and the refrigerating expansion valve 66*b*.

The operations of the above-described components are controlled by a microcomputer (not shown).

The operation of the third example of the refrigeration cycle will now be described.

In a freezing mode for making a temperature Tf of the freezing chamber F reach a set freezing temperature $Tf_0$, the microcomputer opens the first solenoid valve 84*a* and closes the second solenoid valve 84*b*, so that the refrigerants can pass through the freezing expansion valve 66*a*, operates the freezing chamber fan 72, and stops the refrigerating chamber fan 74.

Therefore, the refrigerants are circulated through the compressor 62, the condenser 64, the freezing expansion valve 66*a*, the evaporator 68 and the auxiliary expansion valve 66*c*. As the freeing chamber fan 72 is operated, the cool air heat-exchanged in the freezing chamber side region 68*a* is supplied merely to the freezing chamber F, to cool the freezing chamber F.

In a refrigerating mode for making a temperature Tr of the refrigerating chamber R reach a set refrigerating temperature $Tr_0$, the microcomputer closes the first solenoid valve 84*a* and opens the second solenoid valve 84*b*, so that the refrigerants can pass through the refrigerating expansion valve 66*b*, operates the refrigerating chamber fan 74, and stops the freezing chamber fan 72.

Accordingly, the refrigerants are circulated through the compressor 62, the condenser 64, the refrigerating expansion valve 66*b*, the evaporator 68 and the auxiliary expansion valve 66*c*. As the refrigerating chamber fan 74 is operated, the cool air heat-exchanged in the refrigerating chamber side region 68*b* is supplied merely to the refrigerating chamber R, to cool the refrigerating chamber R.

In a freezing and refrigerating mode for making the temperature Tf of the freezing chamber F and the temperature Tr of the refrigerating chamber R reach the set freezing temperature $Tf_0$ and the set refrigerating temperature $Tr_0$, respectively, the first solenoid valve 84*a* is opened and the second solenoid valve 84*b* is closed, so that the refrigerants can pass through the freezing expansion valve 66*a*, the freezing chamber fan 72 is continuously operated, and the refrigerating chamber fan 74 is operated and stopped at intervals of a predetermined time.

As a result, the refrigerants are circulated through the compressor 62, the condenser 64, the freezing expansion valve 66*a*, the evaporator 68 and the auxiliary expansion valve 66*c*. As the freezing chamber fan 72 is operated, the cool air heat-exchanged in the freezing chamber side region 68*a* is supplied to the freezing chamber F, and as the refrigerating chamber fan 74 is intermittently operated, the cool air heat-exchanged in the refrigerating chamber side region 68*b* is supplied to the refrigerating chamber R during the operation, thereby cooling both the freezing chamber F and the refrigerating chamber R.

In a defrosting mode for making the temperature Tf of the freezing chamber F and the temperature Tr of the refrigerating chamber R reach a defrosting temperature Ti for removing ice from the surface of the evaporator 68, the compressor 62 is stopped, the first and second solenoid valves 84*a* and 84*b* are closed, the freezing chamber fan 72 is stopped, and the refrigerating chamber fan 74 is operated.

In a state where the refrigerants are not circulated, the refrigerating chamber side region 68*b* of the evaporator 68 is defrosted by the air sent by the operation of the refrigerating chamber fan 74, and the freezing chamber side region 68*a* of the evaporator 68 is defrosted by the heat transmitted from the refrigerating chamber side region 68*b*.

In the defrosting mode, if the temperature Tf of the freezing chamber F and the temperature Tr of the refrigerating chamber R do not reach the defrosting temperature Ti, the first and second solenoid valves 84*a* and 84*b* are opened to circulate the refrigerants having a relatively high temperature along the evaporator 68, and defrosting heaters installed at the lower portion of the evaporator 68 are heated to defrost the evaporator 68.

Identically to the first example of the refrigeration cycle, the third example of the refrigeration cycle improves the cooling speed of the refrigerating chamber R more than the general refrigeration cycle by cooling the freezing chamber F and the refrigerating chamber R, respectively, efficiently cools a large capacity of refrigerator, and individually effectively defrosts the freezing chamber F and the refrigerating chamber R.

Figure 12:
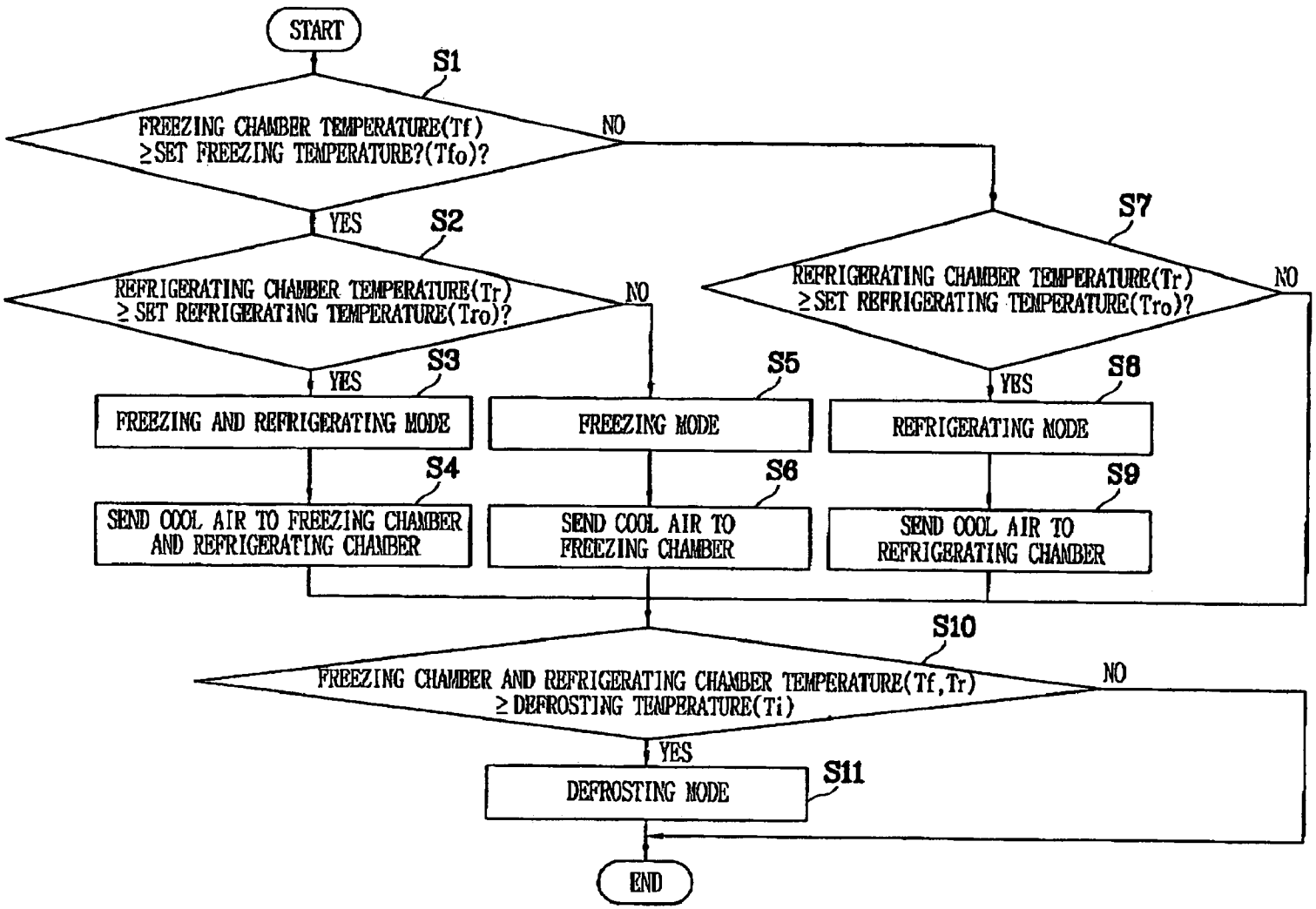
FIG. 12 is a flowchart showing sequential steps of a method for controlling an operation of a refrigerator in accordance with a preferred embodiment of the present invention.

FIG. 12 is a flowchart showing sequential steps of a method for controlling an operation of a refrigerator in accordance with a preferred embodiment of the present invention.

The method for controlling the operation of the refrigerator will now be explained with reference to FIG. 12, and the components of the refrigerator will now be explained with reference to FIGS. 7 to 9.

In the first step, a temperature Tf of a freezing chamber F and a temperature Tr of a refrigerating chamber R are compared with a set freezing temperature $Tf_0$ and a set refrigerating temperature $Tr_0$, for sensing a freezing load and a refrigerating load, and an operation mode of the refrigerator is determined (refer to S1, S2, S3, S5, S7 and S8).

In detail, the set freezing temperature $Tf_0$ and the set refrigerating temperature $Tr_0$ are set by the user or automatically set, and the temperature Tf of the freezing chamber F and the temperature Tr of the refrigerating chamber R sensed in the freezing chamber F and the refrigerating chamber R are compared with the set freezing temperature $Tf_0$ and the set refrigerating temperature $Tr_0$, thereby determining the operation mode of the refrigerator.

Here, when the temperature Tf of the freezing chamber F is higher than the set freezing temperature $Tf_0$ and the temperature Tr of the refrigerating chamber R is higher than the set refrigerating temperature $Tr_0$, a freezing and refrigerating mode is selected, when the temperature Tf of the freezing chamber F is higher than the set freezing temperature $Tf_0$ but the temperature Tr of the refrigerating chamber R is lower than the set refrigerating temperature $Tr_0$, a freezing mode is selected, when the temperature Tf of the freezing chamber F is lower than the set freezing temperature $Tf_0$ but the temperature Tr of the refrigerating chamber R is higher than the set refrigerating temperature $Tr_0$, a refrigerating mode is selected, and when the temperature Tf of the freezing chamber F is lower than the set freezing temperature $Tf_0$ and the temperature Tr of the refrigerating chamber R is lower than the set refrigerating temperature $Tr_0$, a cooling mode is not selected.

In the second step, a cooling operation is performed by sending cool air to the freezing chamber F and the refrigerating chamber R, the freezing chamber F or the refrigerating chamber R according to the mode set in the first step (refer to S4, S6 and S9).

Here, when the freezing and refrigerating mode is selected, a compression flow rate and a decompression degree are maximized, and the cool air is sent to the freezing chamber F and the refrigerating chamber R.

Therefore, refrigerants are compressed, condensed, expanded and evaporated sequentially through the compressor 62, the condenser 64, the expansion means 66 and the evaporator 68, for cooling air near the evaporator 68. Here, the ambient air can be rapidly cooled by remarkably controlling the compression flow rate and the decompression degree. When a freezing chamber fan 72 and a refrigerating chamber fan 74 installed at the upper portions of a freezing chamber side region 68*a* and a refrigerating chamber side region 68*b* of the evaporator 68 are operated, the cool air passing through the freezing chamber side region 68*a* of the evaporator 68 is circulated in the freezing chamber F, and the cool air passing through the refrigerating chamber side region 68*b* of the evaporator 68 is circulated in the refrigerating chamber R.

When the freezing mode is selected, the compression flow rate and the decompression degree are relatively remarkably controlled, and the cool air is sent merely to the freezing chamber F.

Only the freezing chamber fan 72 is operated, and thus the cool air passing through the freezing chamber side region 68*a* of the evaporator 68 is circulated in the freezing chamber F.

In the freezing mode, if the temperature Tr of the refrigerating chamber R gets higher than the set refrigerating temperature $Tr_0$, part of the cool air of the freezing chamber F can be supplied to the refrigerating chamber R.

When the refrigerating mode is selected, the compression flow rate and the decompression degree are relatively slightly controlled, and the cool air is sent merely to the refrigerating chamber R.

Only the refrigerating chamber fan 74 is operated, and thus the cool air passing through the refrigerating chamber side region 68*b* of the evaporator 68 is circulated in the refrigerating chamber R.

Especially, in the refrigerating mode, a temperature of the evaporator 68 is preferably higher than that of the freezing chamber F and lower than that of the refrigerating chamber R.

In the third step, while the cooling operation is performed in each mode in the second step, the temperature Tf of the freezing chamber F and the temperature Tr of the refrigerating chamber R are compared with a previously-inputted defrosting temperature Ti, and a defrosting mode is determined according to the comparison result (refer to S10 and S11).

Here, the surface of the evaporator 68 may be frosted during the cooling operation in each mode. The frosted surface of the evaporator 68 reduces heat exchange efficiency of the evaporator 68. Accordingly, the surface of the evaporator 68 needs to be defrosted.

Because the evaporator 68 does not perform a heat exchange operation with ambient air due to frost, the temperature Tf of the freezing chamber F or the temperature Tr of the refrigerating chamber R relatively increases. If the temperature Tf of the freezing chamber F or the temperature Tr of the refrigerating chamber R gets higher than the defrosting temperature Ti, the defrosting mode is started.

In detail, in the defrosting mode, in a state where the refrigerants are stopped not to flow, the refrigerating chamber fan 74 is operated so that the air of the refrigerating chamber R having a relatively high temperature can be sent and circulated to defrost the refrigerating chamber side region 68*b* of the evaporator 68. Here, the freezing chamber side region 68*a* of the evaporator 68 is also defrosted by heat transfer effects.

In addition, in the defrosting mode, the high temperature high pressure liquid refrigerants are supplied to the evaporator 68, and the refrigerating chamber fan 74 is rotatably operated, thereby efficiently performing the defrosting operation.

Furthermore, in the defrosting mode, defrosting heaters installed at the lower portion of the evaporator 68 are heated to rapidly perform the defrosting operation.

As discussed earlier, the side-by-side type refrigerator where the freezing chamber F and the refrigerating chamber R are disposed side by side in accordance with the preferred embodiments of the present invention has been described with reference to the accompanying drawings. However, it is understood that the present invention should not be limited to these preferred embodiments but various changes and modifications can be made by one skilled in the art within the spirit and scope of the present invention as hereinafter claimed.

What is claimed is:

1. A refrigerator, comprising:

a compressor being operated to compress refrigerants into high temperature high pressure gas refrigerants;

a condenser being operated to condense the refrigerants compressed in the compressor into high temperature high pressure liquid refrigerants;

a decompression device being operated to expand the refrigerants condensed in the condenser into low temperature low pressure liquid refrigerants;

an evaporator being operated to evaporate the refrigerants expanded in the decompression device into low temperature low pressure gas refrigerants, wherein a heat exchange region of the evaporator is divided into a freezing chamber side region and a refrigerating chamber side region by a blocking plate;

a freezing chamber circulation passage formed in the refrigerator and being operated to supply cool air from the freezing chamber side region into a freezing chamber, wherein a freezing chamber fan is installed in the freezing chamber circulation passage and is being operated to direct cool air to the freezing chamber;

a refrigerating chamber circulation passage formed in the refrigerator that is separate from the freezing chamber circulation passage, wherein the refrigerating chamber circulation passage is being operated to supply cool air from the refrigerating chamber side region into a refrigerating chamber, wherein a refrigerating chamber fan is installed in the refrigerating chamber circulation passage and is being operated to direct cool air to the refrigerating chamber, wherein the decompression device comprises a freezing expansion means and a refrigerating expansion means installed side by side between the condenser and the evaporator to combine refrigerant tubes formed at the front and rear ends, the freezing expansion means and the refrigerating expansion means being different in capacity; and a valve device installed between the condenser and the freezing expansion means and the refrigerating expansion means, wherein the valve device is being operated to selectively supply the refrigerants from the condenser to the freezing expansion valve or the refrigerating expansion valve, and wherein, in a freezing and refrigerating mode for making a temperature of the freezing chamber and a temperature of the refrigerating chamber reach a set freezing temperature and a set refrigerating temperature, respectively, the valve device directs the refrigerants to pass through the freezing expansion means, the freezing chamber fan is continuously operated, and the refrigerating chamber fan is operated and stopped at intervals of a predetermined period of time.

2. The refrigerator of claim 1, wherein the freezing expansion means and the refrigerating expansion valve are capillary tubes.

3. The refrigerator of claim 1, wherein the valve device is a three way valve installed on a refrigerant tube branched from the condenser into the freezing expansion means and the refrigerating expansion valve, being operated to vary a passage of the refrigerants.

4. The refrigerator of claim 3, wherein the valve device comprises first and second solenoid valves installed on refrigerant tubes formed at the front ends of the freezing expansion valve and the refrigerating expansion means, being operated to vary a passage of the refrigerants.

5. The refrigerator of claim 1, wherein, in the freezing mode for making the temperature of the freezing chamber reach a set freezing temperature, the valve device directs the refrigerants to pass through the freezing expansion means, the freezing chamber fan is operated, and the refrigerating chamber fan is stopped.

6. The refrigerator of claim 1, wherein, in the refrigerating mode for making the temperature of the refrigerating chamber reach a set refrigerating temperature, the valve device directs the refrigerants to pass through the refrigerating expansion means, the refrigerating chamber fan is operated, and the freezing chamber fan is stopped.

7. A refrigerator, comprising:

a compressor being operated to compress refrigerants into high temperature high pressure gas refrigerants;

a condenser being operated to condense the refrigerants compressed in the compressor into high temperature high pressure liquid refrigerants;

a decompression device being operated to expand the refrigerants condensed in the condenser into low temperature low pressure liquid refrigerants;

an evaporator being operated to evaporate the refrigerants expanded in the decompression device into low temperature low pressure gas refrigerants, wherein a heat exchange region of the evaporator is divided into a freezing chamber side region and a refrigerating chamber side region by a blocking plate;

a freezing chamber circulation passage formed in the refrigerator and being operated to supply cool air from the freezing chamber side region into a freezing chamber, wherein a freezing chamber fan is installed in the freezing chamber circulation passage and is being operated to direct cool air to the freezing chamber;

a refrigerating chamber circulation passage formed in the refrigerator that is separate from the freezing chamber circulation passage, wherein the refrigerating chamber circulation passage is being operated to supply cool air from the refrigerating chamber side region into a refrigerating chamber, wherein a refrigerating chamber fan is installed in the refrigerating chamber circulation passage and is being operated to direct cool air to the refrigerating chamber, wherein the decompression device comprises a freezing expansion means and a refrigerating expansion means installed side by side between the condenser and the evaporator to combine refrigerant tubes formed at the front and rear ends, the freezing expansion means and the refrigerating expansion means being different in capacity; and a valve device installed between the condenser and the freezing expansion means and the refrigerating expansion means, wherein the valve device is being operated to selectively supply the refrigerants from the condenser to the freezing expansion valve or the refrigerating expansion valve, and wherein, in a defrosting mode for making a temperature of the freezing chamber and a temperature of the refrigerating chamber reach a defrosting temperature for removing ice from a surface of the evaporator, the compressor is stopped, the valve device prevents the refrigerants from passing through the freezing expansion means or the refrigerating expansion means, the freezing chamber fan is stopped, and the refrigerating chamber fan is operated.

8. The refrigerator of claim 7, wherein, in the defrosting mode, when the temperature of the freezing chamber and the temperature of the refrigerating chamber do not reach the defrosting temperature, the valve device directs the refrigerants to pass through the freezing expansion means and the refrigerating expansion means, and defrosting heaters installed at a lower portion of the evaporator are heated.

9. The refrigerator of claim 7, wherein the freezing expansion means and the refrigerating expansion means are capillary tubes.

10. The refrigerator of claim 7, wherein the valve device is a three way valve installed on a refrigerant tube branched from the condenser into the freezing expansion means and the refrigerating expansion means, being operated to vary a passage of the refrigerants.

11. The refrigerator of claim 10, wherein the valve device comprises first and second solenoid valves installed on refrigerant tubes formed at the front ends of the freezing expansion means and the refrigerating expansion means, being operated to vary a passage of the refrigerants.

12. The refrigerator of claim 7, wherein, in the freezing mode for making the temperature of the freezing chamber reach a set freezing temperature, the valve device directs the refrigerants to pass through the freezing expansion means, the freezing chamber fan is operated, and the refrigerating chamber fan is stopped.

13. The refrigerator of claim 7, wherein, in the refrigerating mode for making the temperature of the refrigerating chamber reach a set refrigerating temperature, the valve device directs the refrigerants to pass through the refrigerating expansion means, the refrigerating chamber fan is operated, and the freezing chamber fan is stopped.

14. The refrigerator of claim 8, wherein the defrosting heaters comprises a defrosting heater for the freezing chamber having a relatively large capacity installed at the lower portion of the freezing chamber side region of the evaporator and a defrosting heater for the refrigerating chamber having a relatively small capacity installed at the lower portion of the refrigerating chamber side region of the evaporator.

15. The refrigerator of claim 14, wherein the defrosting heaters comprises radiant heaters.

* * * * *

UNITED STATES PATENT AND TRADEMARK OFFICE

CERTIFICATE OF CORRECTION

PATENT NO. : 7,726,141 B2
APPLICATION NO. : 10/871703
DATED : June 1, 2010
INVENTOR(S) : Jae-Seng Sim et al.

It is certified that error appears in the above-identified patent and that said Letters Patent is hereby corrected as shown below:

On the title page, insert item:

--[30] Foreign Application Priority Data

Dec. 24, 2002 (KR) 10-2002-0083289--

Signed and Sealed this

Thirty-first Day of August, 2010

David J. Kappos

David J. Kappos
*Director of the United States Patent and Trademark Office*